US005707295A

United States Patent [19]

Shingledecker

[11] Patent Number: 5,707,295

[45] Date of Patent: Jan. 13, 1998

[54] SWING

[76] Inventor: David Noel Shingledecker, 3803 Dudley Dr., Mishawaka, Ind. 46544

[21] Appl. No.: 754,989

[22] Filed: Nov. 22, 1996

[51] Int. Cl.[6] ..... A63G 9/12

[52] U.S. Cl. ..... 472/120; 472/121

[58] Field of Search ..... 472/118, 120, 472/121, 133, 14

[56] References Cited

U.S. PATENT DOCUMENTS

| | | | |
|---|---|---|---|
| 3,567,220 | 3/1971 | Cox | 472/121 |
| 5,393,268 | 2/1995 | Cunard et al. | 472/120 |
| 5,580,317 | 12/1996 | Yun | 472/120 |

*Primary Examiner*—Kien T. Nguyen
*Attorney, Agent, or Firm*—Leo H. McCormick, Jr.

[57] ABSTRACT

A swing having a stationary support member to which is pivotally attached to first and second arms. The first and second arms are in turn pivotally attached by connectors on side wings that extend from a base member. The base member has an arcuate surface that extends from a first end to a second end with the side wings extending on a tangent from the second end for a fixed distance to a terminus point. The center of gravity of the attached base member is selected such that the base member is in an approximate horizontal plane with the first and second arms in a rest position. A person mounts the base member to define a prone position with their hands on a handle adjacent the first end and feet located on a support attached to the terminus point of the side wings. As the person propels the base member in an arc about a first pivot of the first and second arms and stationary support, the base member pivots rotates in a counter manner on yokes which attached the side wings. The first and second ends of the base member remain in a substantially proportional and equal distances from a ground lines as the base member sequentially moves through parallel and horizontal planes with respect to the ground line to give the person a sensation of speed.

10 Claims, 6 Drawing Sheets

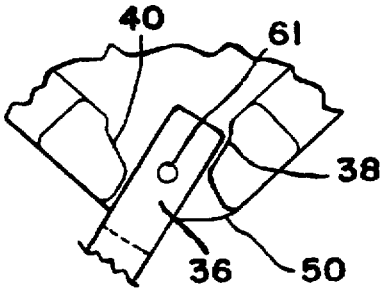
FIG. 11-B
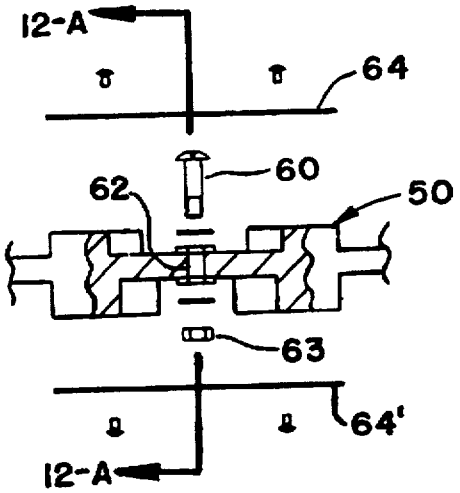
FIG. 12
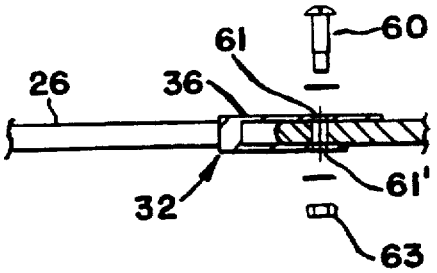
FIG. 12-A
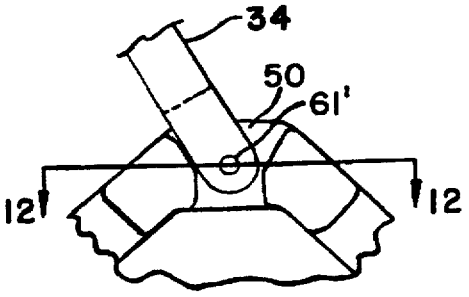
FIG. 11-A

SWING

The invention relates to a swing and in particular a swing wherein a person is positioned in and substantially remains in a prone position when propelling a base member through an arc about a pivot point.

Swings have used throughout history in various configurations. In a simple swing, a single rope is tied to a stationary fixture. This type swing is propelled by grabbing the rope and being pushed in an are about the stationary fixture. Unfortunately is necessary to hold on to the rope at all times in order to stay on this type swing. Later a seat was attached to the rope and another rope was added to the stationary structure. This type of swing is common today however the type of seat available and used depends on the age of the person desiring to use the swing. More recently, swings have been designed to represent various devices of transportation such as horses, cars and even airplanes. In such swings it is common to have three or four linkage members located at various locations around the swing to simulated such transportation devices. In such devices a person sits upright position and travels in an arc about the fixed point of attachment of the linkage members.

SUMMARY OF THE INVENTION

In the present invention, a swing structure is provided whereby a person is in and remains in a substantially prone position while traveling in an arc about the fixed point of attachment of a stationary fixture. A base for the swing structure pivots about a connector member in a direction which is counter to the arcuate motion about the fixed point of attachment with the stationary fixture such that the base and person remain in sequential planes parallel with a ground line. By remaining in sequential parallel planes, the person is provided with a sensation of speed as compared with merely traveling in a constant arc about the fixed point of attachment with the stationary fixture.

It is an object of the present invention to provide a swing with a base member which moves in a first arc about a stationary fixture while counter pivoting in a second arc about a connector such that a person situated on the base member remains in a substantially prone position.

It is a further object of this invention to provide a swing with structure whereby a person remains in a prone position while sequentially propelling the swing.

An advantage that this swing structure has over the known prior art is a greater sensation of speed which is imparted by remaining in a substantially prone during the completion of an arcuate cycle about a stationary fixture as a result of the availability of eye contact with the ground.

These objects and advantages should be apparent from reading this specification while viewing the drawings.

BRIEF DESCRIPTION OF THE DRAWINGS

FIG. 11A is a view of an inside leg of a yoke member of the circumscribed line 11 of FIG. 8;

FIG. 11B is a view of an outside leg of the yoke member of FIG. 11A;

FIG. 12 is an assembly view of an apex point on a side wall and associate cover which receives for yoke member illustrated in FIGS. 11A and 11B;

FIG. 12-A is a sectional view taken along line 12-A—12-A of FIG.12;

DETAILED DESCRIPTION OF THE INVENTION

Throughout this specification, like parts are identified by the same number with a added to the identification number when used the various Figures.

Figure 1:
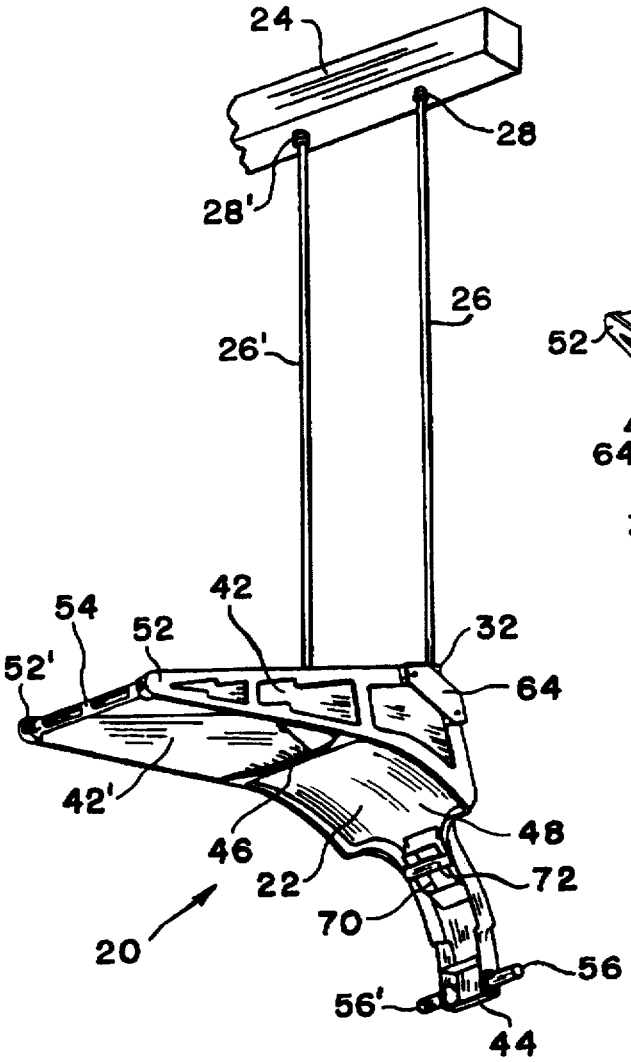
FIG. 1 is a prospective view looking up at the swing structure from a ground level which is made according to this invention.
Figure 2:
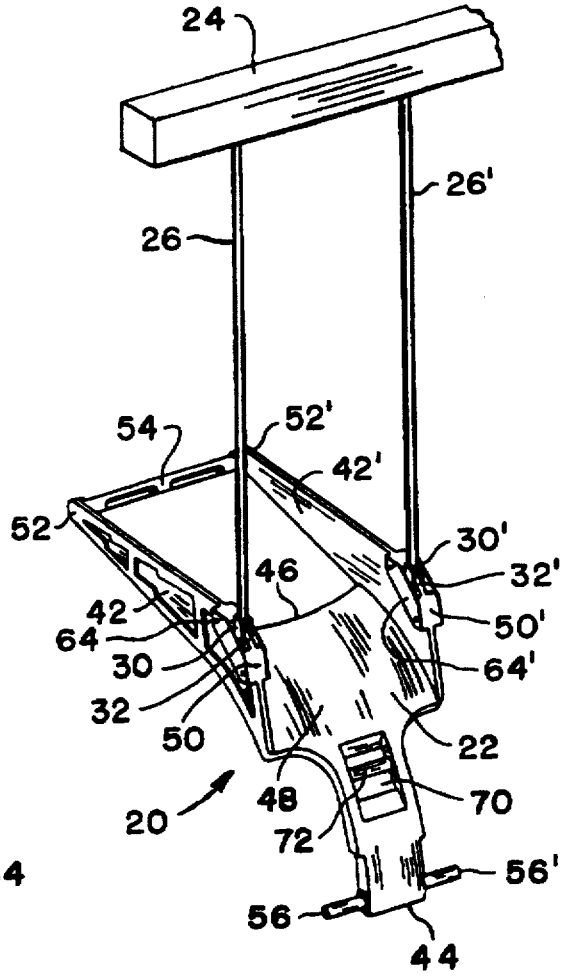
FIG. 2 is a prospective frontal view looking down at the swing structure of FIG. 1.

The swing structure 20 shown in FIGS. 1 and 2 is designed for a person to lay in a prone position while traveling about a stationary structure 24. The swing structure has a base member 22 which is connected to the stationary structure 24 by first 26 and second 26' arms. The first arm 26 and second arm 26' each have a first end 28,28' which is pivotally connected to the stationary structure 24 and a second end 30,30' connected to yoke members 32,32'. Yoke members 32, 32', (as best shown in FIGS. 11A and 11B) are attached to the second ends 30,30' of the first arm 26 through brackets connected to a base member 22. The yoke members 32 and 32' allow the base member 22 to be maintained in successive horizontal planes while traveling in an are about the stationary structure 24. By remaining in such successive horizontal planes, a person experiences a sensation of speed as the base member 22 moves in the arc about the point of attachment with the stationary structure 24.

In more particular detail, the base member 22 as further illustrated in FIGS. 1,2,6, 7, and 13, has a first end 44 and a second end 46 with an arcuate surface that substantially extends from the first end 44 to the second end 46. First 42 and second 42' perpendicular side wings extend in an upward direction are attached to the base member 22 beginning at a point approximately mid-way between the first 44 and second 46 ends. Each side wing 42,42' extends above the base member 22 to an apex point 50,50' and extends past the second end 46 to a terminus point 52,52'. That portion of the side wings 42,42' located past the second end 46 is located along a tangent of the arcuate surface 48 of the base member 22. The apex points 50,50' set pivotally connected to the corresponding yoke members 32,32' by pivot pins 60,60'. Each yoke member 32,32' has an inside leg 34 and an outside leg 36. As illustrated in FIG. 11-B, the outside leg 36 extends past a pivot point a fixed distance to define a rectangular end while the inside leg 32 has a semicircular end as shown in FIG. 11-A. The outside led 36 is designed to engage stop members 38 and 40 located on the side wall or wing 42 extending from the base member 22. Pins 60,60' extend through the openings 62,62' at the apex points 50,50' in the side walls 42,42' and through openings 61,61' in yokes 32, 32', see FIG. 12-A to join the base member 22 to the first 26 and second 26' arms. First 64 and second 64' cover or end plates attached to the side walls 42,42' prevent the pins 60,60' from being removed once nuts 63,63' are attached. In addition the end plates 64,64' prevent the insertion of a finger or other part of a person in the area of the stop members 38,40 where it could be pinched while the base member 22 is swinging about the stationary structure 24.

Figure 13B:
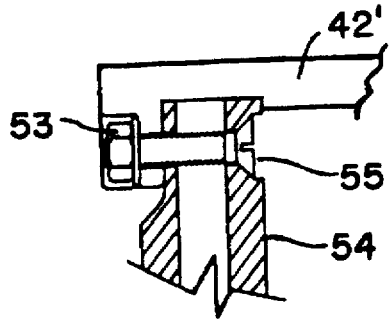
FIG. 13B is a view taken along line 13B—13B of FIG. 13.
Figure 13A:
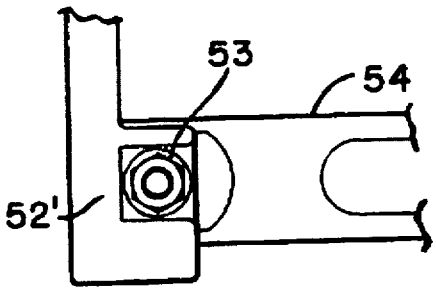
FIG. 13A is a view taken along line 13A—13A of FIG. 13 which illustrates a foot support and hidden connector for joining a first side wall with a second side wall.
Figure 13:
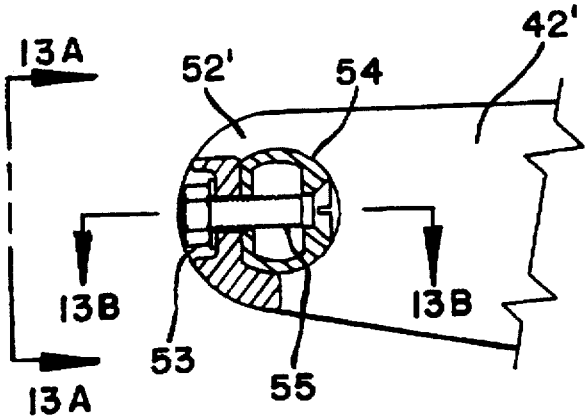
FIG. 13 is a view taken circumscribed area 13 of FIG. 8.

A support 54 as best shown in FIGS. 13A and 13B, is attached to the terminus points connects the side wings 42,42' by bolts 55 and nuts 53. The head on a bolt 55 is recessed into an opening in the side walls 42,42' such that no sharp component extends outside of the support 54. The support 54 aids in forming a rigid rectangular structure for the swing.

Figure 6:
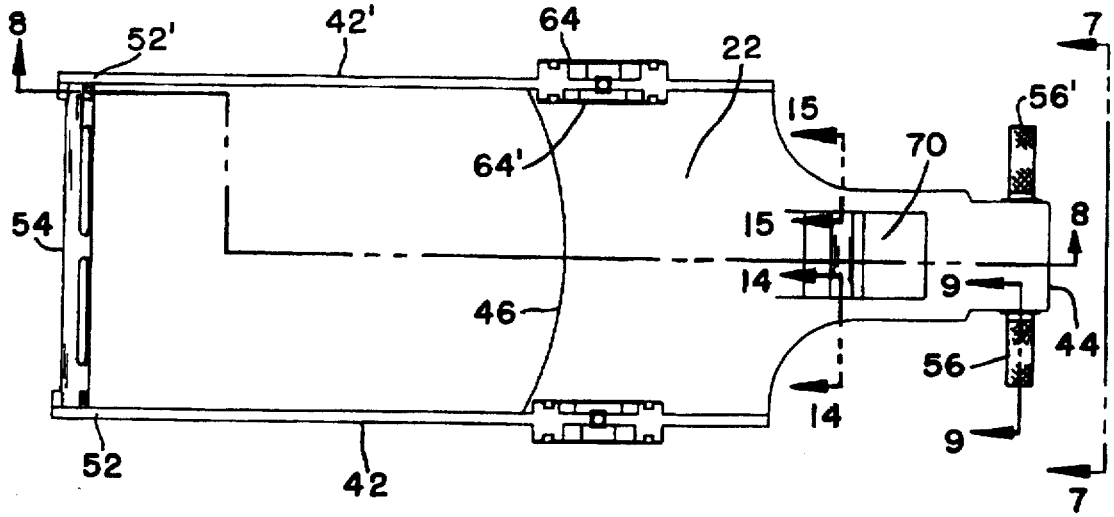
FIG. 6 is a top view of a base member for the swing structure of FIG. 1.
Figure 7:
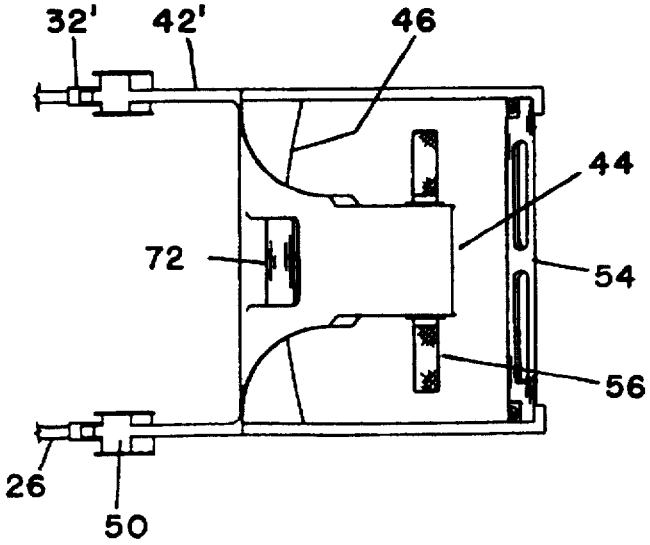
FIG. 7 is a view taken along line 7—7 of FIG. 6.
Figure 9:
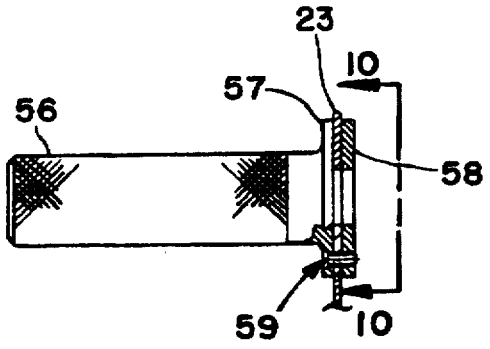
FIG. 9 is a sectional view taken along line 9—9 of FIG. 6.
Figure 10:
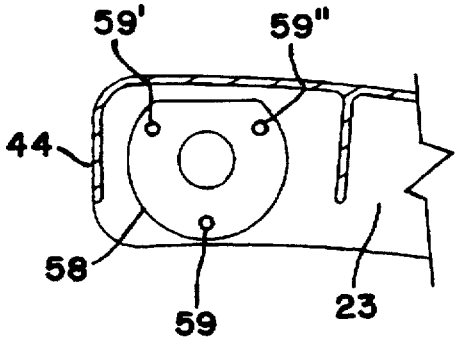
FIG. 10 is a view taken along line 10—10 of FIG. 9.

The width of the base member 22 ahead of the side wings 42,42 narrows to form a projection that extends to the first end 44, as clearly shown in FIGS. 6 and 7. The width of the projection is about one half the width of the base member 22 and is such that the arms of a person will be conformable when be aligned in the area between a vertical plane parallel with the side wings 42,42'. First 56 and second 56' handles are secured to the side walls 23,23' of projection of the base member 22 at a location adjacent the first end 44. The handles 56,56', as shown in detail in FIGS. 9 and 10, each have a base 57 which engages the side wall 23 of the projection and is secured thereto by screws 59,59',59" that extend through backing plate 58.

Figure 14:
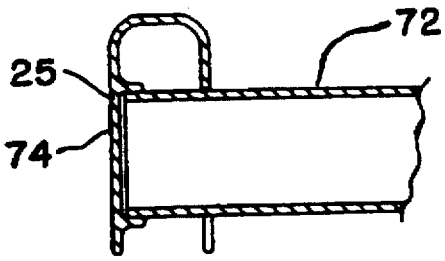
FIG. 14 illustrates a hand grasp member shown by lines 14—14 of FIG. 6.
Figure 15:
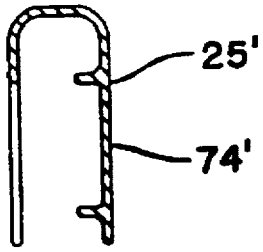
FIG. 15 illustrates a portion of the base member prior to the insertion of the hand grasp member of FIG. 14.

In addition, the projection from the base 22, as seen in FIGS. 6 and 7, has a cut out opening 70 in which is located an additional hand hold or rung 72. Hand hold 72 is snap fit into semi-arcuate ribs 74,74' on side walls 25,25' of the projection as shown in FIGS. 14 and 15.

Figure 3:
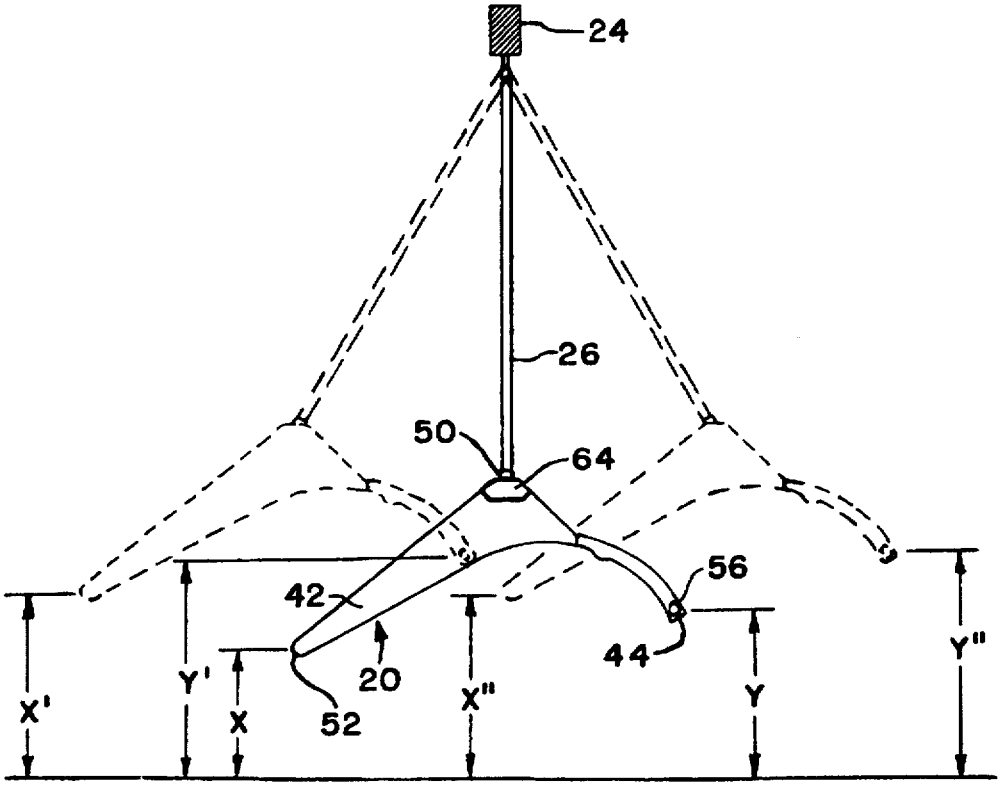
FIG. 3 is a side view of the swing structure showing sequential arcuate travel about a stationary fixture.
Figure 8:
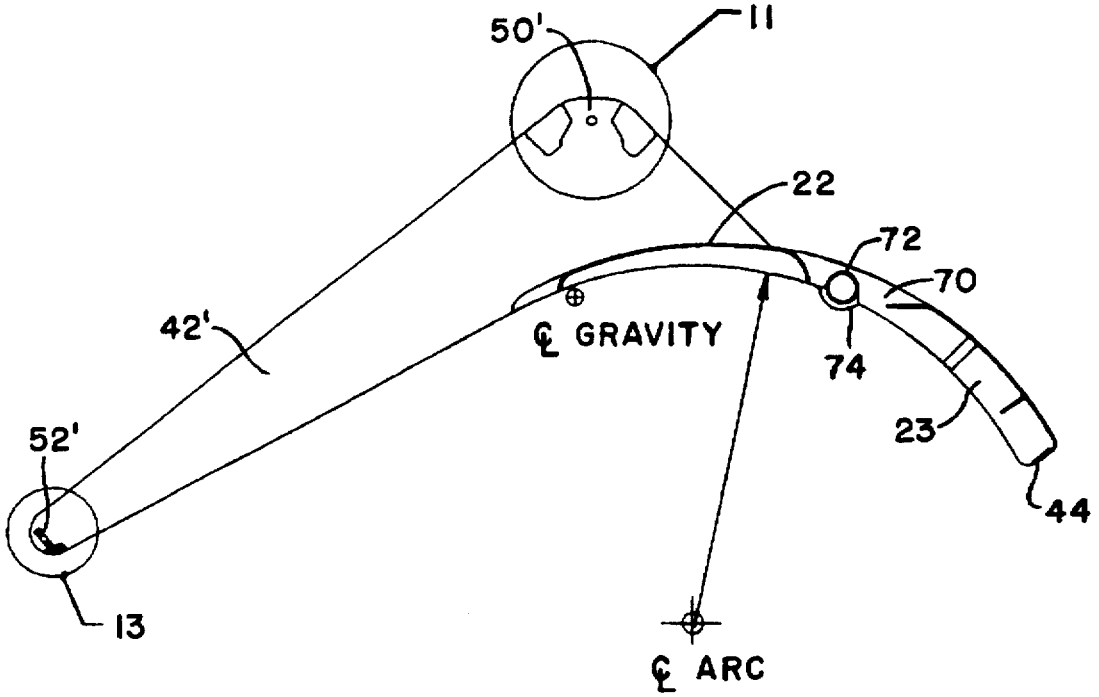
FIG. 8 is a sectional view taken along line 8—8 of FIG. 6.

The location of the first 56 and second 56' handles on the projection of base 22 are selected with respect to the first end 44 such that the center of gravity of the arcuate base member 22, first 42 and second 42' side wings, and support 54 is in a vertical plane with the first 26 and second 26' arm and passes through a point adjacent the second end 46 as best shown in FIG. 8. In this manner the first end 44 and support member 54 remain in substantially a same parallel relationship with the ground as the swing 20 moves through an arc about the stationary structure 24. With the swing 20 in the rest position as shown in FIG. 3, the base member 22 is in a horizontal plane while the first 26 and second 26' arms are in a perpendicular position with respect to the stationary structure 24.

Figure 4:
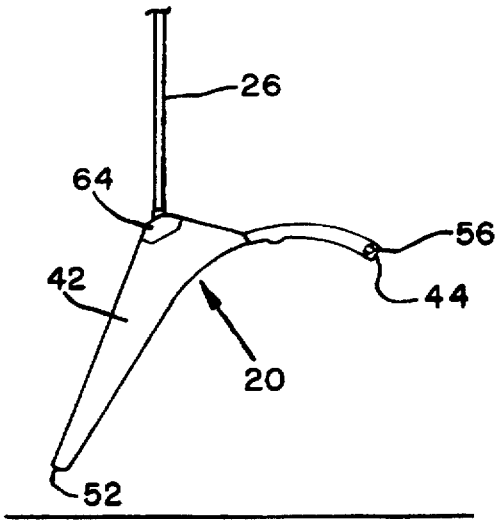
FIG. 4 is a side view of the swing structure showing a first maximum rotation about an attachment linkage.
Figure 5:
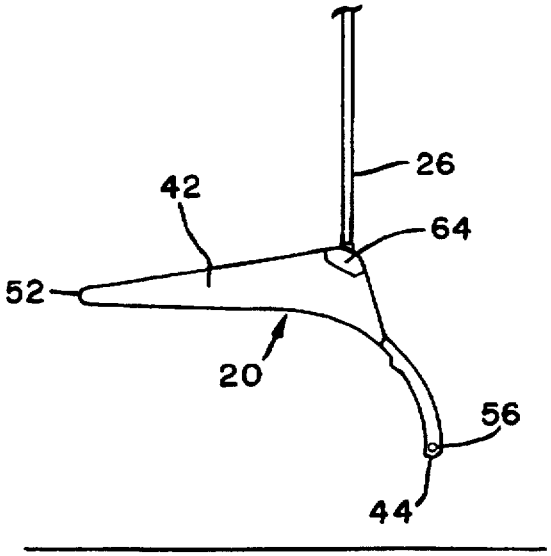
FIG. 5 is a side view of the swing structure showing a second maximum rotation about the attachment linkage.

When a person desires to mount swing 20 it is desirable to place a foot on support 54 and bring the base member 22 into a position as shown in FIG. 4. The engagement of the outside legs 36,36' of yokes 32,32' with stop members 40,40' prevent the base member 22 from any further rotation about the second end 30,30' of arms 26,26'. If necessary, the person can grab rung 72 or the handles 56,56' and lay down on the base member 22. Once a person is mounted on the base member 22 in a prone position, the outside legs 36,36' of yokes 32,32' engage stop members 38,38' to prevent rotation and as a result the support 54 attached to the terminus points 52,52' on the side walls or wings 42,42' for base member 22 is prevented from rotating past a horizontal plane with respect to the ground, as shown in FIG. 5. Thus, a person is prevented from being dumped of the base member 22.

The swing 20 is propelled by the action of a person moving his legs to pump and create a force which is counter to gravity. This pumping action moves the swing 20 through an are such that the first end 44 and support 54 remain at substantially the same x-y relationship (x'-y' at one extreme of the arcuate movement and x"-y" at the other extreme of the arcuate movement) as the swing 20 moves, see the illustrated in FIG. 3.

The stops 38 and 40 are selected such that the swing moves in arc of approximately 60 degrees in an unrestricted manner. Thus, person who is in a prone position on the base member 22 remains in a series of horizontal planes which are parallel to the ground and experiences a sensation of speed as the base member 22 moves in an are while continuously pivoting with a counter rotation with respect to the stationary structure 24.

I claim:

1. A swing comprising:

a stationary member;

a first arm having a first end pivotally attached to said stationary member and a second end;

a second arm having a first end pivotally attached to said support member and a second end;

a base member having a first end and a second end, said base member having an arcuate surface that substantially extends from said first end to said second end, said base member having first and second perpendicular side wings with first and second apex points, respectively, located above said base and first and second terminus points, said first and second terminus points being located along tangents that extend from said second end of said base member;

a support attached to said first and second terminus points;

a handle secured to said base member at a location adjacent said first end; and connector means for pivotally joining said second end of said first and second arms to said first and second apex points, said first and second arms allowing a person to propel said base in a first arc about said stationary member while said base member is maintained in sequential horizontal planes by pivoting about said connector means to impart a sensation of speed to the person.

2. The swing as recited in claim 1 wherein said connector means includes:

stop means which limit the pivotal movement about said first and second apex points.

3. The swing as recited in claim 2 wherein said base member has a projection that extends from a mid-point between said first and second ends, said projection having approximately one-half of the width of said base member from said second end to said midpoint.

4. The swing as recited in claim 3 wherein said handle includes:

a first hand hold; and a second hand hold, said first and second hand holds being connected to said projection at a location such that the center of gravity of said base member with first and second side wings and support is located in a horizontal plane with said first and second arms when the base member is in a stationary position.

5. The swing as recited in claim 4 wherein said connector means includes:

first and second yoke means attached to said second ends of said first and second arms, said first and second yoke means surrounding said first and second apex points, respectively, and each having a pivot pin that joins said base member to said first and second arms.

6. The swing as recited in claim 5 wherein said connector means further includes:

first and second end plates connected to said first and second apex points to prevent said pivot pins from being removed from said first and second yokes while at the preventing exposure of said stops means.

7. The swing as recited in claim 6 wherein said projection further includes:

a central rung located between said base and handle to assist in allowing a person to mount said base member.

8. The swing as recited in claim 7 wherein said first and second ends of said base member on moving through said first arc are maintained at substantially equal distances of vertical planes with respect to the ground.

9. The swing as recited in claim 8 wherein said base remains in a horizontal position with respect to the ground as long as said first arc defined by the fixed point of attachment with the stationary support and first and second arms does not exceed approximately 60 degrees.

10. The swing as recited in claim 9 wherein said center of gravity and the engagement of said first and second stop means prevent said base member from reaching a point above the tangent of said arcuate surface of said base member.

* * * * *